US006084614A

United States Patent [19]

Yamasa et al.

[11] Patent Number: 6,084,614

[45] Date of Patent: Jul. 4, 2000

[54] METHOD AND APPARATUS FOR FORMING AN IMAGE USING FLYING DEVELOPING PARTICLES

[75] Inventors: Hideo Yamasa, Yamatokoriyama; Kouichi Irihara, Nara, both of Japan

[73] Assignee: Sharp Kabushiki Kaishi, Osaka, Japan

[21] Appl. No.: 09/045,312

[22] Filed: Mar. 20, 1998

[30] Foreign Application Priority Data

Mar. 25, 1997 [JP] Japan ..... P9-071021

[51] Int. Cl.[7] ..... B41J 2/06

[52] U.S. Cl. ..... 347/55; 347/141

[58] Field of Search ..... 347/55, 141, 143, 347/147, 151; 399/237, 239; 430/117

[56] References Cited

U.S. PATENT DOCUMENTS

| | | | |
|---|---|---|---|
| 4,024,838 | 5/1977 | Horie | 399/239 |
| 4,154,195 | 5/1979 | Mugrauer | 399/130 |
| 4,227,797 | 10/1980 | Tsunoi et al. | 399/239 |
| 4,982,692 | 1/1991 | Uematsu | 399/239 |
| 5,036,341 | 7/1991 | Larsson | 347/55 X |
| 5,481,341 | 1/1996 | Sypula et al. | 399/239 |
| 5,606,402 | 2/1997 | Fujita et al. | 347/55 |
| 5,781,218 | 7/1998 | Wakahara et al. | 347/55 X |

FOREIGN PATENT DOCUMENTS

| | | |
|---|---|---|
| 761 445 A2 | 3/1997 | European Pat. Off. . |
| 763 785 A1 | 3/1997 | European Pat. Off. . |
| 58-151257 | 8/1983 | Japan . |
| 61-211048 | 9/1986 | Japan . |
| 1-503221 | 11/1989 | Japan . |
| 2-32872 | 2/1990 | Japan . |
| 2-59352 | 2/1990 | Japan . |
| 7-186436 | 7/1995 | Japan . |
| 8-6383 | 1/1996 | Japan . |

OTHER PUBLICATIONS

Lo; Wang: IBM, Technical Disclosure Bulletin, vol. 18, No. 1, Jun. 1975, US, pp. 288–289.

*Primary Examiner*—Arthur T. Grimley
*Assistant Examiner*—Hoan Tran
*Attorney, Agent, or Firm*—Dike, Bronstein, Roberts & Cushman, LLP; David G. Conlin; William J. Daley, Jr.

[57] ABSTRACT

Featured is an imaging forming apparatus that provides minute particles having a uniform diameter and being uniformly charged. The image forming apparatus includes a supplying member that supplies charged developing particles, a counter electrode disposed opposite to the supplying member and a control electrode disposed therebetween and including a plurality of passing holes serving as passages for the developing particles. While a potential for generating a predetermined potential difference is applied between the supplying member and the counter electrode, the potential being applied to the control electrode is changed in order to change an electric field existing between the supplying member and the counter electrode. This controls flying of the developing particles passing through the passing holes in a direction from the supplying member to the counter electrode, and thus the forming of the image. The developing particles are formed of a liquid or liquescent material, and fine-grained and charged with electricity by the supplying member. The supplying member is particularly configured or arranged so the developing particles thereon formed have a diameter to minimize particle fragmentation during flying from the supplying member towards the control electrode.

9 Claims, 9 Drawing Sheets

METHOD AND APPARATUS FOR FORMING AN IMAGE USING FLYING DEVELOPING PARTICLES

BACKGROUND OF THE INVENTION

1. Field of the Invention

The present invention relates to an image forming apparatus, which is applied to a printing section of a digital copying machine and a facsimile machine, and a digital printer, for forming an image on a recording medium by allowing developing particles to fly.

2. Description of the Related Art

There has existed an image forming apparatus for outputting an image signal as a visible image to a recording medium such as paper, which adopts a method generally called "xerography".

This image forming apparatus forms an electrostatic latent image by optical writing means on a developing substance having an electro-optics characteristics, i.e. photoreceptor, and the electrostatic latent image is developed by allowing toner which is developing particles to adhere. Thereafter the apparatus transfers the developed image to a recording medium such as a paper so as to form an image signal as a visible image on the recording medium.

In the above mentioned constitution, however, a developing substance having a special structure for forming an electrostatic latent image as well as writing means for the electrostatic latent image and charge eliminating means for erasing residual electric charge on the developing substance are required.

Furthermore, a constitution that the toner image formed on the photoreceptor is transferred to a recording medium is complex. For this reason, the structure of the apparatus becomes complex and there arises a problem that miniaturization of the apparatus is limited.

In this point of view, an image forming apparatus adopting a toner flying recording system, which forms an image by holding charged toner on a toner holding roller and allowing the toner to directly fly onto a recording medium by means of the Coulomb's force, is disclosed in Japanese Unexamined Patent Publication JP-A 1-503221(1989), Japanese Unexamined Patent Publication JP-A 7-186436(1995) and so on.

In the following context, an image forming apparatus adopting the conventional toner flying recording system will be explained.

FIG. 7 is a structural view of a conventional image forming apparatus, FIG. 8 is an enlarged view of a toner flying part of the conventional image forming apparatus, and FIG. 9 is a plan view of a control electrode in the conventional image forming apparatus.

In FIG. 7, a toner holder 102 is provided in a developing tank 101, and a toner supply roller 103 and a layer thickness restricting member 105 are pressed onto the toner holder 102. Further, a counter electrode 106 is provided opposite to the toner holder 102 with a control electrode 109 being interposed therebetween.

The control electrode 109 includes a plurality of electrodes (x-direction electrodes) arranged in a direction parallel to a longitudinal direction of the toner supply roller, a thin-film insulator 111 having a thickness of some tens of micrometer, and a plurality of electrodes 112 (y-direction electrodes) arranged in a direction intersecting to the x-direction electrodes 110, which are laminated in order, and at each intersection of the x-direction electrode 110 and the y-direction electrode 112 a toner passing hole 113 is formed.

An operation of the image forming apparatus having above described constitution will be explained below. In present case, it is assumed that toner 104 is negatively charged.

The toner 104 contained in the developing tank 101 is supplied to the toner holder 102 by means of the toner supply roller 103. At this time, the toner 104 is negatively charged due to a friction between the toner holder 102 and the toner supply roller 103 and supplied onto the toner holder 102.

The toner 104 adhered to the toner holder 102 is conveyed up to the layer thickness restricting member 105, and then charged again and restricted its layer thickness to a uniform thickness of between 10 $\mu$m and 50 $\mu$m by means of the layer thickness restricting member 105. After which, the toner 104 is conveyed to an opposing position of the control electrode 109.

The control electrode 109 connects with a control circuit 114 which generates a signal corresponding to image information and a driving circuit 115 which applies a voltage based on the signal. To the x-direction electrode 110 and y-direction electrode 112, Va volt is respectively applied when dot printing is carried out and Vb volt is applied when dot printing is not carried out.

To the toner holder 102 is applied Vs volt by an external power supply 116, and to the counter electrode 106 is applied Vt volt by an external power supply 117. The values of Va, Vb, Vs and Vt are predetermined so that flying of the toner may be controlled. That is, these values are determined so that flying of the toner may be controlled by electromagnetically changing the intensity of an electric field formed between the toner holder 102 and the counter electrode 106 by the potentials (Va, Vb) to be applied to the control electrode.

When Va volt is respectively applied to the x-direction electrode 110 and the y-direction electrode 112 during executing dot printing, the toner 104 conveyed in its negatively charged condition up to the opposing position of the control electrode 109 by the toner holder 102, receives an electric field higher than a toner flying start electric field, which causing the toner 104 to fly toward the toner passing hole 113.

The toner 104 having flown up to the toner passing hole 113 receives the force of an electric field along the direction of a recording medium 107 by the counter electrode 106 to which Vt volt is applied, thereby transferring onto the recording medium 107. During not carrying out the dot printing, since Vb volt is applied to either one or both of the x-direction electrode 110 and the y-direction electrode 112, the electric field does not reach the toner flying start electric field and therefore the toner 104 with negative charge would not fly toward the toner passing hole 113.

In order to represent dots as a continuous linear image, the toner passing holes 113 are arranged so as to form four toner passing hole 113 groups which are parallel to the longitudinal direction of the toner holder 102, in a condition that adjacent dots partially overlap to each other. And the image is formed by changing a control timing for each toner passing hole 113 group formed in parallel to the toner holder 102.

Finally, the recording medium 107 on which a visible image is formed is conveyed to a fixing roller 108 and the visible image is fixed on the recording medium 107, thereby obtaining a final image.

However, the conventional constitution is found to have a problem that normal images can not be stably formed for a long period because the toner will accumulate on a surface of the control electrode 109 or the toner will block the hole of the toner passing hole 113.

It is found that this problem tends to arise when there exist a lot of oppositely charged toner and weakly charged toner. Further, through observation of the flying state of the toner, it is found that the toner does not fly particle-by-particle but fly in clusters each composed of several to several tens of toner particles. Accordingly, the toner may break up during flight to fly to the directions different from the initial flying direction, and probably this fact would contribute the above mentioned problem.

For a solution of this problem, implementation was made to add in the developing tank an apparatus for eliminating the oppositely or weakly charged toner (in Japanese Unexamined Patent Publication JP-A 8-6383(1996), for example), but this solution has a problem of making the apparatus complex and increasing the cost.

SUMMARY OF THE INVENTION

The present invention was made to solve the above mentioned problem, and is directed to provide image forming apparatus and method capable of stably obtaining an excellent image for a long period without executing a maintenance such as cleaning or changing of the control electrode, and to provide stable developing particle supplying method and apparatus requiring lower cost and saving space.

A first aspect of the invention provides an image forming apparatus comprising:

a supplying member for supplying charged developing particles;

a counter electrode disposed opposite to the supplying member; and a control electrode disposed between the supplying member and the counter electrode and having a plurality of passing holes serving as passages for the developing particles;

in which while different potentials are applied to the supplying member and the counter electrode, respectively, to generate a predetermined potential difference therebetween, a potential which is to be applied to the control electrode is changed, in order to change an electric field existing between the supplying member and the counter electrode, to thereby control flying of the developing particles passing through the passing holes in a direction from the supplying member to the counter electrode, thereby forming an image, wherein the developing particles are formed of a liquid or a liquescent material, and fine-grained and charged with electricity by the supplying member.

In a second aspect of the invention, the image forming apparatus is characterized in that the supplying member is mesh-formed, or a surface of the supplying member is worked into a mesh form.

In a third aspect of the invention, the image forming apparatus is characterized in that a surface of the supplying member is worked into a dimple form.

In a fourth aspect of the invention, the image forming apparatus is characterized in that a surface of the supplying member is worked so as to be divided into regions of different wettabilities with resect to the liquid developing particles.

In a fifth aspect of the invention, the image forming apparatus is characterized in that the supplying member has a number of minute holes which penetrate the supplying member in a thickness direction thereof.

A sixth aspect of the invention provides an image forming method comprising the steps of:

applying different potentials to a supplying member for supplying charged developing particles and a counter electrode disposed opposite to the supplying member, respectively, to generate a predetermined potential difference therebetween, and at the same time, changing a potential to be applied to a control electrode which is disposed between the supplying member and the counter electrode and has a plurality of passing holes which serve as passages for the developing particles, so as to change an electric field existing between the supplying member and the counter electrode, to thereby control flying of the developing particles passing through the passing holes in a direction from the supplying member to the counter electrode, wherein the developing particles are formed of a liquid or a liquescent material, and fine-grained and charged with electricity by the supplying member.

As described above, since the image forming method and apparatus of the invention can easily obtain fine particles of a uniform diameter and a uniform charge, the developing particles will never accumulate on the surface of the control electrode 9 shown in FIGS. 1 and 5, for example, and block the developing particle passing holes 13. Consequently, it is possible to stably obtain excellent images for a long period without executing maintenance such as cleaning or changing of the control electrode.

The present invention can provide image forming method and apparatus which require lower cost and saving space by eliminating the need for a special charging device or a special fixing device.

BRIEF DESCRIPTION OF THE DRAWINGS

Other and further objects, features, and advantages of the invention will be more explicit from the following detailed description taken with reference to the drawings wherein.

Figure 1:
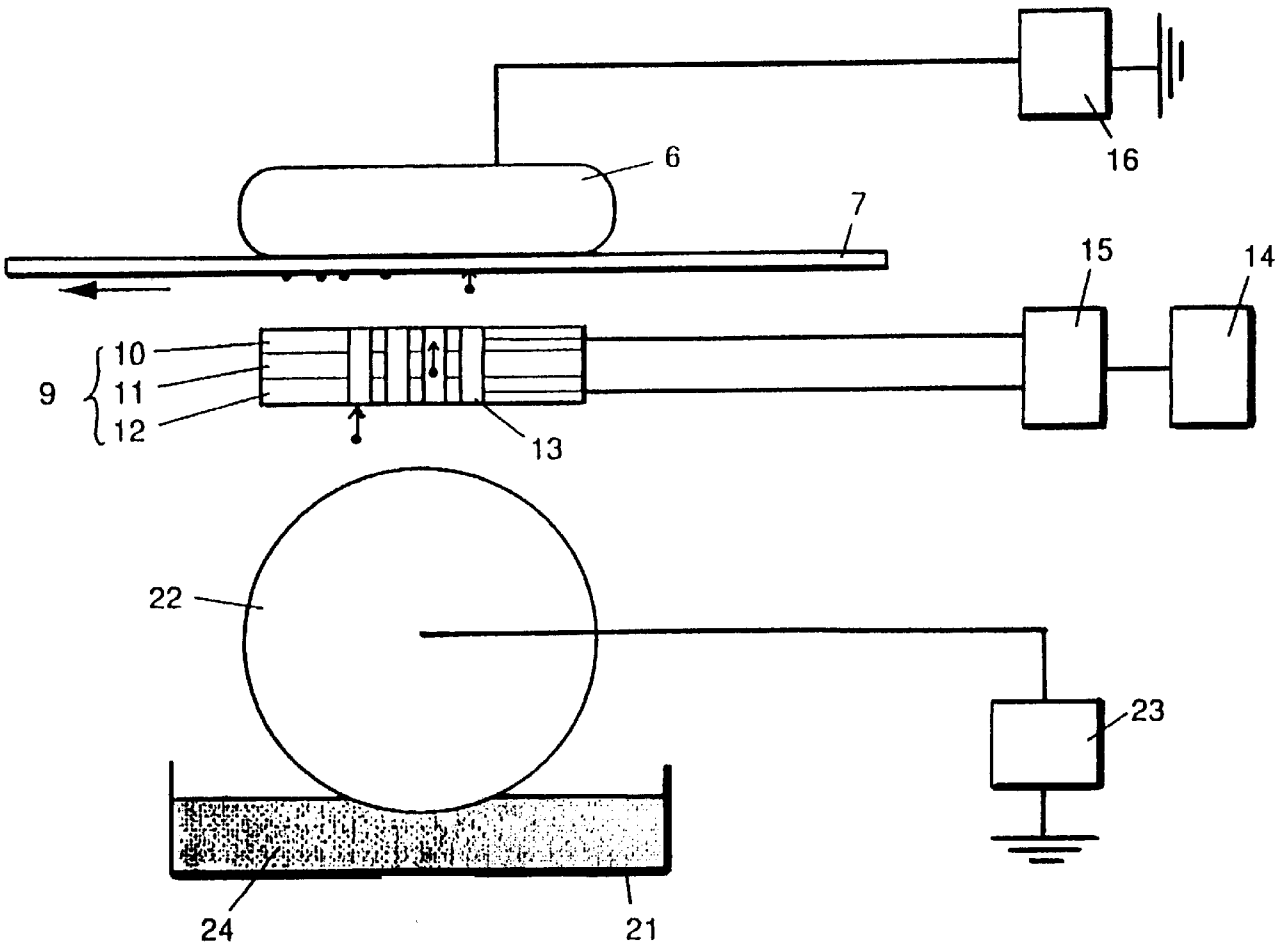
FIG. 1 is a structural view of an image forming apparatus in first to third embodiments of the invention.

DETAILED DESCRIPTION OF THE PREFERRED EMBODIMENTS (Embodiment 1)

Now referring to the drawings, a first embodiment of the invention is described below.

Figure 2:
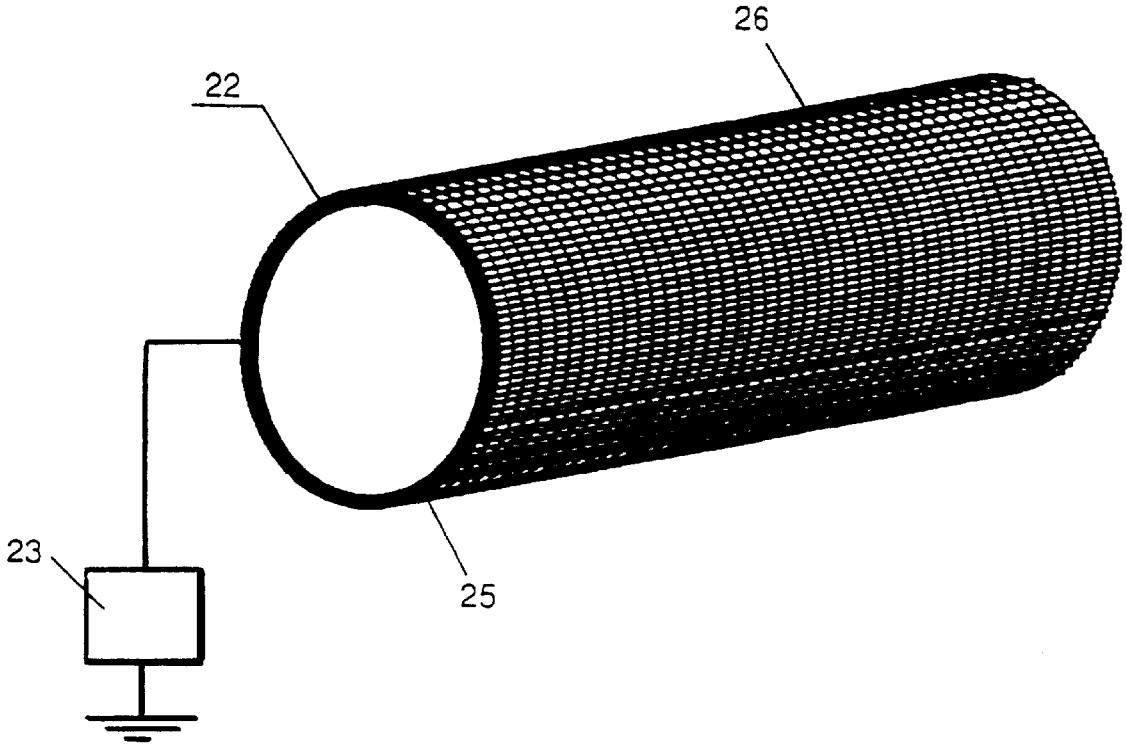
FIG. 2 is an enlarged perspective view of a developing particle supplying device in the first embodiment of the invention.

FIG. 1 is a block diagram of image forming apparatus of first, second and third embodiments. FIG. 2 is an enlarged perspective view of a developing particle supplying member of the first embodiment of the invention.

In FIG. 1, a lower periphery of liquid developing particle supplying member 22 is partially immersed into ink 24 in an ink tank 21. A counter electrode 6 is disposed in a position facing to the developing particle supplying member 22 via a control electrode 9.

In the control electrode 9, a plurality of electrodes 10 (X-direction electrodes) arranged in parallel with the longitudinal direction of the liquid developing particle supplying member, an insulator 11 in a form of thin film having a thickness of tens of μm, and a plurality of electrodes 12 (Y-direction electrodes) extending in a direction intersecting with the X-direction electrodes 10 are laminated in this order, and ink particle passing holes 13 are formed in positions where the X-direction electrodes 10 and the Y-direction electrodes 12 intersect with each other.

FIG. 2 shows an example of the structure of the liquid developing particle supplying member 22.

An electrically conductive mesh 26 is wound around an electrically conductive holding drum 25. The thickness and size of grains of the mesh 26 are predetermined so that an ink particle is thereon formed to have a proper diameter when flying.

As to the image forming apparatus structured in the above manner, the operation thereof is illustrated below. Since the lower part of the liquid developing particle supplying member 22 (the electrically conductive mesh 26 and the holding drum 25) is immersed into the ink 24 in the ink tank 21, the ink 24 is held in the grains of the mesh 26 due to the surface tension thereby supplied toward a position which faces to the control electrode 9 as a result of the rotation of the mesh 26.

In the meantime, since a negative voltage is applied to the holding drum 25 and the mesh 26 by an external power supply 23, a charge-injection into the ink 24 is occurred, with the result that the ink 24 is uniformly negatively charged without variations of the amount of electrical charge.

The control electrode 9 is connected to a control circuit 14 which generates a signal in correspondence with an image information and a driving circuit 15 which applies a voltage based on the signal. To the X-direction electrode 10 and the Y-direction electrode 12 that are selected in the control circuit 14, −100 V is respectively applied when dot printing is carried out, and −300 V is applied when printing is not carried out. −200 V is applied to the holding tube 25 and the mesh 26, and +400 V is applied to the counter electrode 6. Since, to the ink 24 conveyed by the mesh 26 to a position facing to the control electrode 9 in a negatively charged condition, −100 V is applied respectively by the X-direction electrode and the Y-direction electrode when dot printing is carried out, the ink 24 has higher voltage than the fly start voltage, and receives the force of an electric field to fly in the direction of the ink particle passing holes 13.

The ink 24 that flies to the ink particle passing holes 13 receives the force of an electric field in the direction of a recording medium 7 from the counter electrode 6 to which +400 V is applied, thereby transferring on the recording medium 7. Since the size of grains of the mesh 26 is predetermined so that the ink particles are thereon formed to have a proper diameter, it is easy to obtain ink particles having a uniform diameter and being uniformly charged, without causing the ink particles to split in the course of flying.

When dot printing is not carried out, since −300 V is applied to either the X-direction electrode 10 or the Y-direction electrode 12, or both of them, there is no fear that the negatively charged ink 24 flies toward the ink particle passing holes 13.

In order to display dots as a linear image, the ink particle passing holes 13 are arranged to form four lines of groups of the ink particle passing holes 13 parallel with the longitudinal direction of the liquid developing particle supplying member 22 in a condition where adjacent dots are partially superposed on each other, so that the control timing is changed for every group of the ink particle passing holes 13 formed to be parallel with the liquid developing particle supplying member 22 thereby forming an image.

Lastly, an ink image formed on the recording medium 7 is obtained as a final image after being absorbed and dried on the recording medium.

(Embodiment 2)

Now referring to the drawings, a second embodiment of the invention is described below.

Figure 3A:
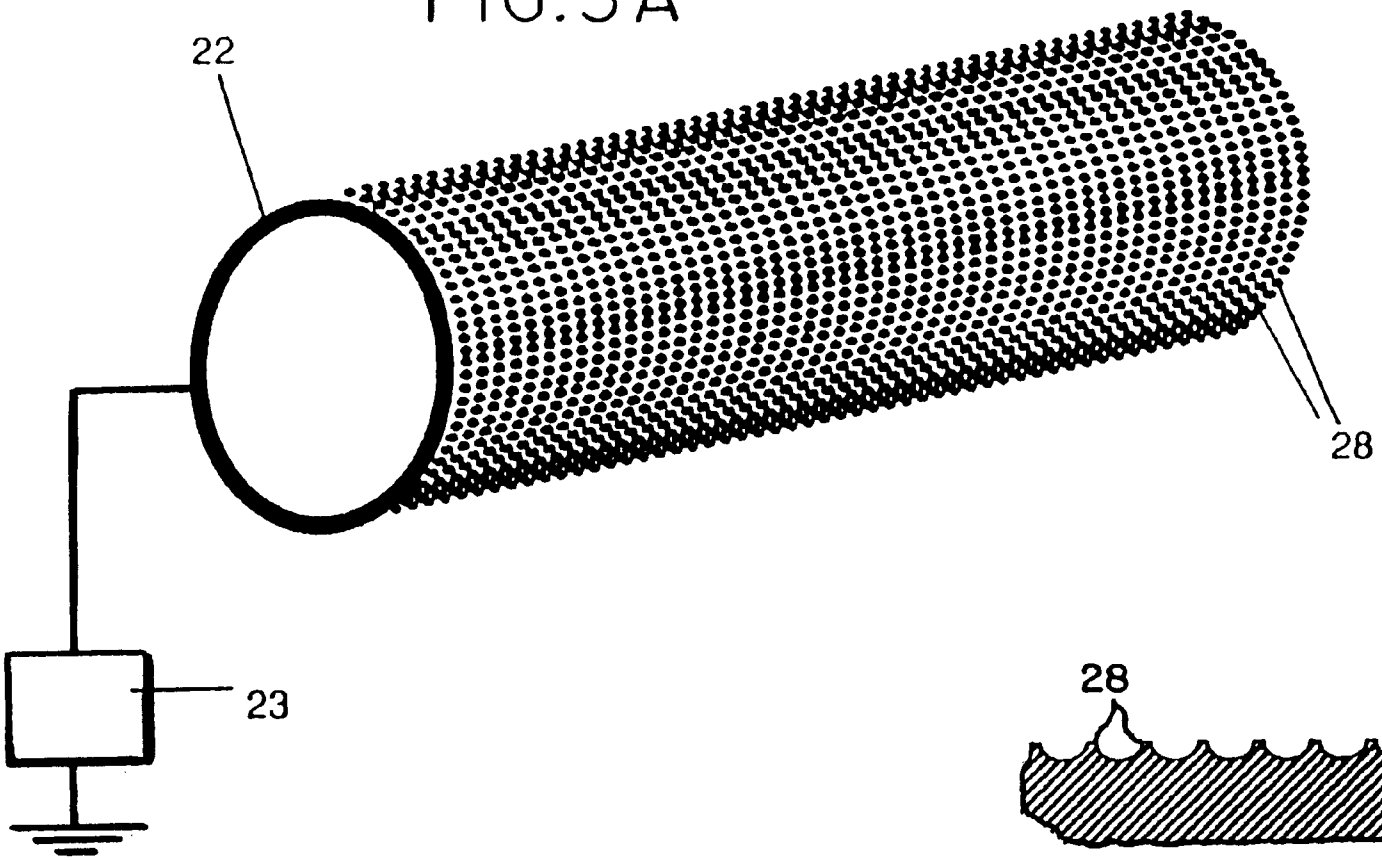
FIG. 3A is an enlarged perspective view of a developing particle supplying device in the second embodiment of the invention.

FIG. 1 is a block diagram of an image forming apparatus of first, second and third embodiments. FIG. 3 is an enlarged perspective view of a developing particle supplying member of the second embodiment of the invention.

In FIG. 1, a lower periphery of a liquid developing particle supplying member 22 is partially immersed into ink 24 in an ink tank 21.

A counter electrode 6 is disposed in a position facing to the liquid developing particle supplying member 22 via a control electrode 9.

In the control electrode 9, a plurality of electrodes 10 (X-direction electrodes) which are placed in parallel with the longitudinal direction of the liquid developing particle supplying member, an insulator 11 in a form of thin film having a thickness of tens of μm, and a plurality of electrodes 12 (Y-direction electrodes) extending in the direction intersecting with the X-direction electrodes 10 are laminated, and ink particle passing holes 13 are formed in positions where the X-direction electrodes 10 and the Y-direction electrodes 12 intersect with each other.

Figure 3B:
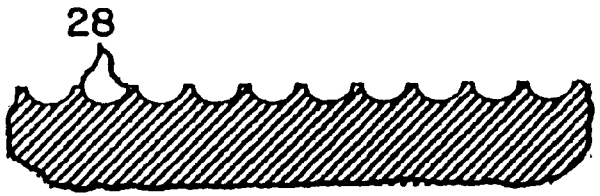
FIG. 3B is an enlarged partial cross-sectional view of the developing particle supplying member of FIG. 3A.

FIG. 3B shows an example of the structure of the liquid developing particle supplying member 22.

Minute dimples 28 which are uniform in size are formed on a surface of the electrically conductive liquid developing particle supplying member 22. The size and depth of the dimples 28 are predetermined so that an ink particle is thereon formed to have a proper diameter when flying.

As to the image forming apparatus structured in the above manner, the operation thereof is illustrated below.

Since the lower part of the liquid developing particle supplying member 22 is immersed into the ink 24 in the ink tank 21, the ink 24 is held in the dimples 28 due to the surface tension thereby supplied toward a position which faces to the control electrode 9 as the result of the rotation of the dimples 28.

In the meantime, since a negative voltage is applied to the liquid developing particle supplying member 22 by an external power supply 23, charge-injection into the ink 24 in the dimples 28 is occurred, with the result that the ink 24 is uniformly negatively charged without variations in the amount of electrical charge.

The control electrode 9 is connected to a control circuit 14 which generates a signal in correspondence to image information and a driving circuit 15 to which a voltage is applied based on the signal. To the X-direction electrode 10 and the Y-direction electrode 12 that are selected in the control circuit 14, −100 V is respectively applied when dot printing is carried out, and −300 V is applied when printing is not carried out. To the liquid developing particle supplying member 22 is applied −200 V, and +400 V is applied to the counter electrode 6. Since to the ink 24 conveyed by the dimples 28 to a position facing to the control electrode 9 in a negatively charged condition is applied −100 V by each of the X-direction electrode and the Y-direction electrode when dot printing is carried out, the ink 24 has higher voltage than the flying start voltage, and receives the force of an electric field to fly in the direction of the ink particle passing holes 13.

The ink 24 that flies to the ink particle passing holes 13 receives the force of the electric field in the direction of a recording medium 7 from the counter electrode 6 to which +400 V is applied, thereby transferring on the recording medium 7.

Since the size and depth of the dimples 28 are predetermined so that the ink particles are thereon formed to have a proper diameter, it is easy to obtain ink particles having a uniform diameter and being uniformly charged, without causing the ink particles to split in the course of flying.

When dot printing is not carried out, since −300 V is applied to either the X-direction electrode 10 or the Y-direction electrode 12, or both of them, there is no fear that the negatively charged ink 24 flies toward the ink particle passing holes 13.

In order to show dots as a liner image, the ink particle passing holes 13 are arranged to form four lines of groups of the ink particle passing holes 13 parallel with the longitudinal direction of the liquid developing particle supplying member 22 in a condition where adjacent dots are partially superposed on each other, so that the control timing is changed for every group of the ink particle passing holes 13 formed to be parallel with the liquid developing particle supplying member 22 thereby forming an image.

Lastly, an ink image formed on the recording medium 7 is obtained as a final image after being absorbed and dried on the recording medium.

(Embodiment 3)

Now referring to the drawings, a third embodiment of the invention is described below.

Figure 4A:
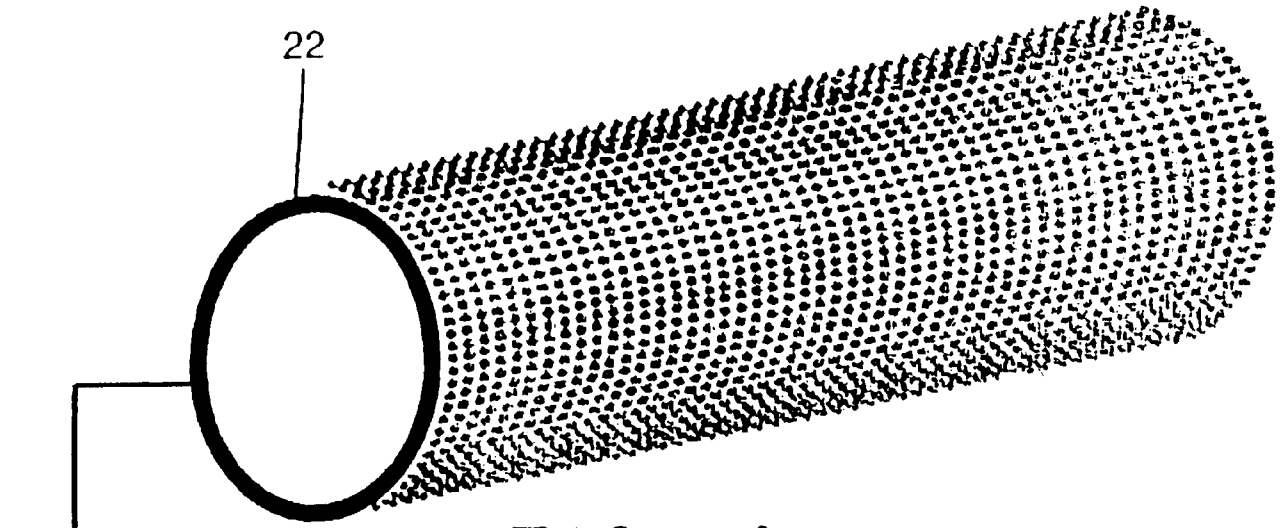
FIG. 4A is an enlarged perspective view of a developing particle supplying device in the third embodiment of the invention.

FIG. 1 is a block diagram of an image forming apparatus of first, second and third embodiments. FIG. 4 is an enlarged perspective view of a developing particle supplying member of the third embodiment of the invention.

In FIG. 1, a lower periphery of a liquid developing particle supplying member is partially immersed into ink 24 in an ink tank 21.

A counter electrode 6 is disposed in a position facing to the liquid developing particle supplying member 22 via a control electrode 9.

In the control electrode 9, a plurality of electrodes 10 (X-direction electrodes) arranged in parallel with the longitudinal direction of the liquid developing particle supplying member, an insulator 11 in a form of thin film having a thickness of tens of $\mu$m, and a plurality of electrodes 12 (Y-direction electrodes) extending in the direction intersecting with X-direction electrodes 10 are laminated, and ink particle passing holes 13 are formed in positions where the X-direction electrodes 10 and the Y-direction electrodes 12 intersect with each other.

Figure 4B:
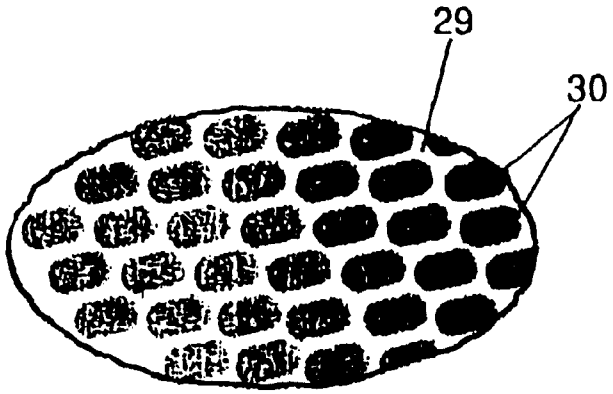
FIG. 4B is an enlarged view of a portion of the developing particle supplying member of FIG. 4A.

FIG. 4B shows an example of the structure of the liquid developing particle supplying member 22.

Areas 29 and 30 are different from each other in wettability to the ink 24. The surface of the electrically conductive liquid developing particle supplying member 22 is treated so that the area 29 rejects ink and the area 30 has an affinity for ink. The sizes of the areas 29 and 30 are predetermined so that an ink particle is thereon formed to have a proper diameter when flying.

As to the image forming apparatus structured in the above manner, the operation thereof is illustrated below. Since the lower part of the liquid developing particle feeder 22 is immersed into the ink 24 in the ink tank 21, the ink 24 is held on the area 30 due to the surface tension thereby supplied toward a position which faces to the control electrode 9 as a result of the rotation of the area 30. In the meantime, since a negative voltage is applied to the liquid developing particle supplying member 22 by an external power supply 23, a charge-injection into the ink 24 on the dimples 28 is occurred, with the result that the ink 24 is uniformly negatively charged without variations of the amount of electrical charge.

The control electrode 9 is connected to a control circuit 14 which generates a signal in correspondence with an image information and a driving circuit 15 which applies a voltage based on the signal. To the X-direction electrode 10 and the Y-direction electrode 12 that are selected in the control circuit 14, −100V is respectively applied when dot printing is carried out, and −300 V is applied when printing is not carried out. To the liquid developing particle feeder 22 is applied −200 V, and a voltage of +400 V is applied to the counter electrode 6. Since, to the ink 24 conveyed by the area 30 to a position facing to the control electrode 9 in a negatively charged condition, −100 V is applied respectively by the X-direction electrode and the Y-direction electrode when dot printing is carried out, the ink 24 has higher voltage than the flying start voltage, and receives the force of an electric field to fly in the direction of the ink particle passing holes 13.

The ink 24 that flies to the ink particle passing holes 13 receives the force of an electric field in the direction of a recording medium 7 from the counter electrode 6 to which +400 V is applied, thereby transferring on the recording medium 7. Since the size of the area 30 is predetermined so that the ink particles are thereon formed to have a proper diameter, it is easy to obtain ink particles having a uniform diameter and being uniformly charged, without causing the ink particles to split in the course of flying.

When dot printing is not carried out, since −300 V is applied to either the X-direction electrode 10 or the Y-direction electrode 12, or both of them, there is no fear that the negatively charged ink 24 flies toward the ink particle passing holes 13.

In order to show dots as a liner image, the ink particle passing holes 13 are arranged to form four lines of groups of the ink particle passing holes 13 parallel with the longitudinal direction of the liquid developing particle supplying member 22 in a condition where adjacent dots are partially superposed on each other, so that the control timing is changed for every group of the ink particle passing holes 13 formed to be parallel with the liquid developing particle supplying member 22 to thereby form an image.

Lastly, an ink image formed on the recording medium 7 is obtained as a final image after being absorbed and dried on the recording medium.

(Embodiment 4)

Now referring to the drawings, a fourth embodiment of the invention is described below.

Figure 5:
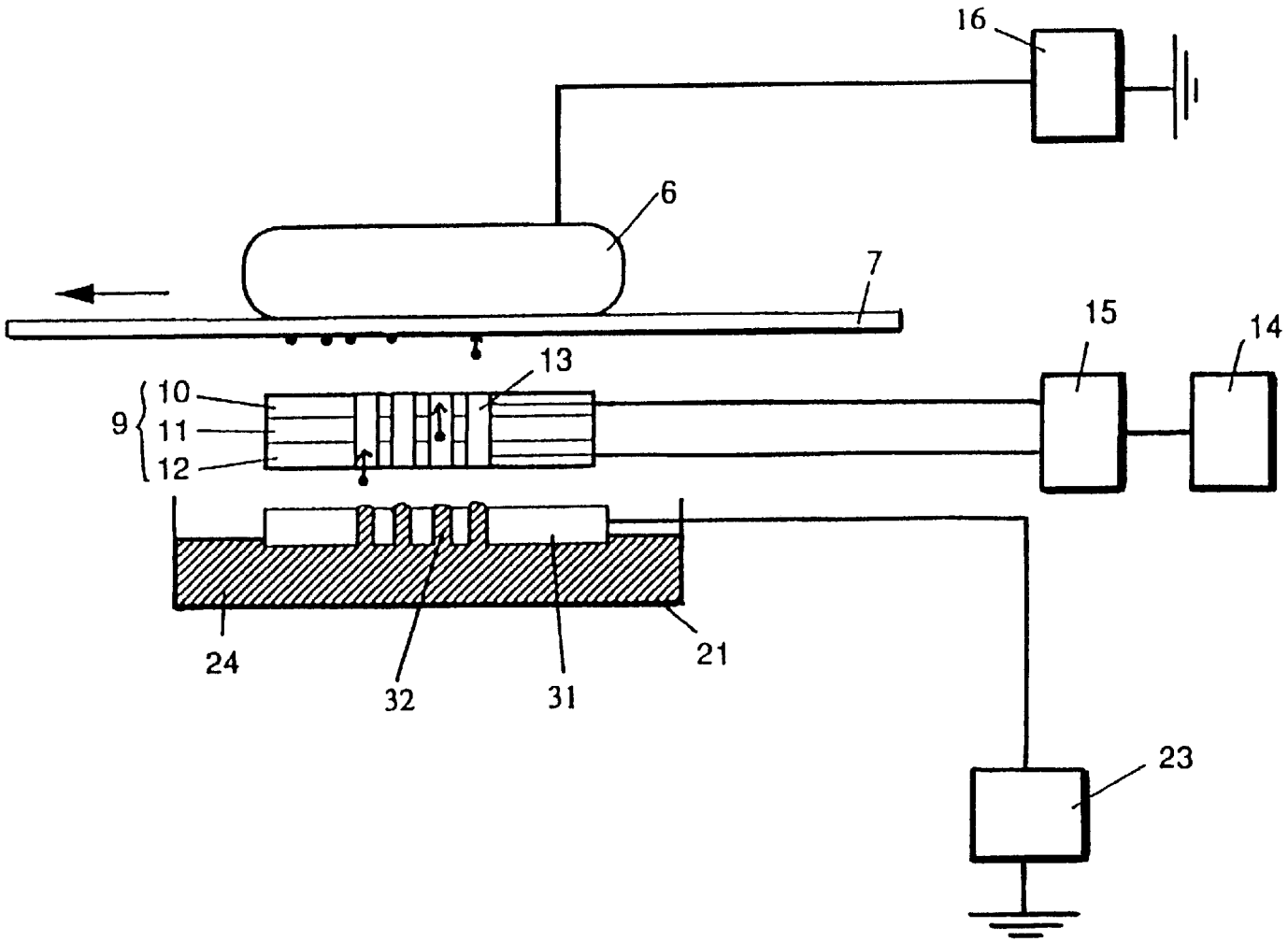
FIG. 5 is a structural view of an image forming apparatus in a fourth embodiment of the invention.
Figure 6:
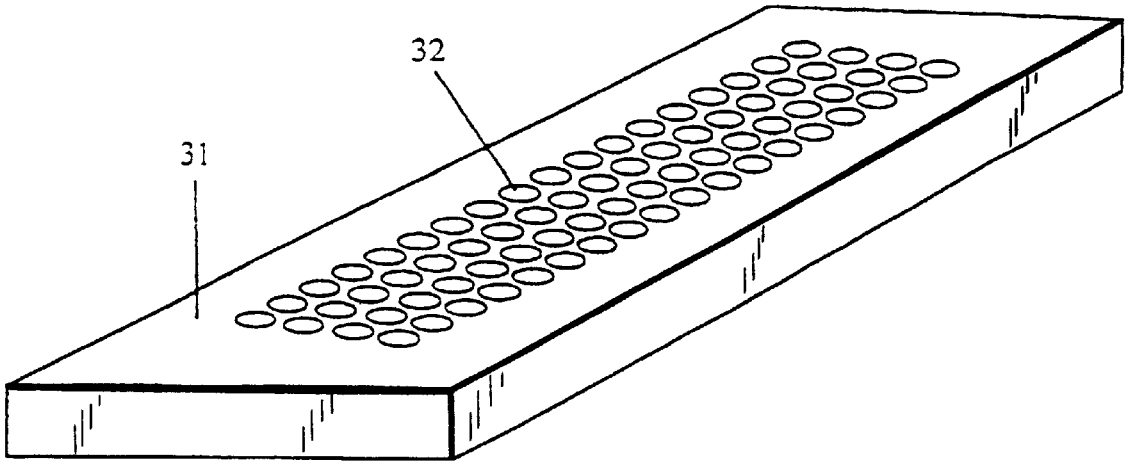
FIG. 6 is an enlarged perspective view of a developing particle supplying device in the fourth embodiment of the invention.
Figure 7:
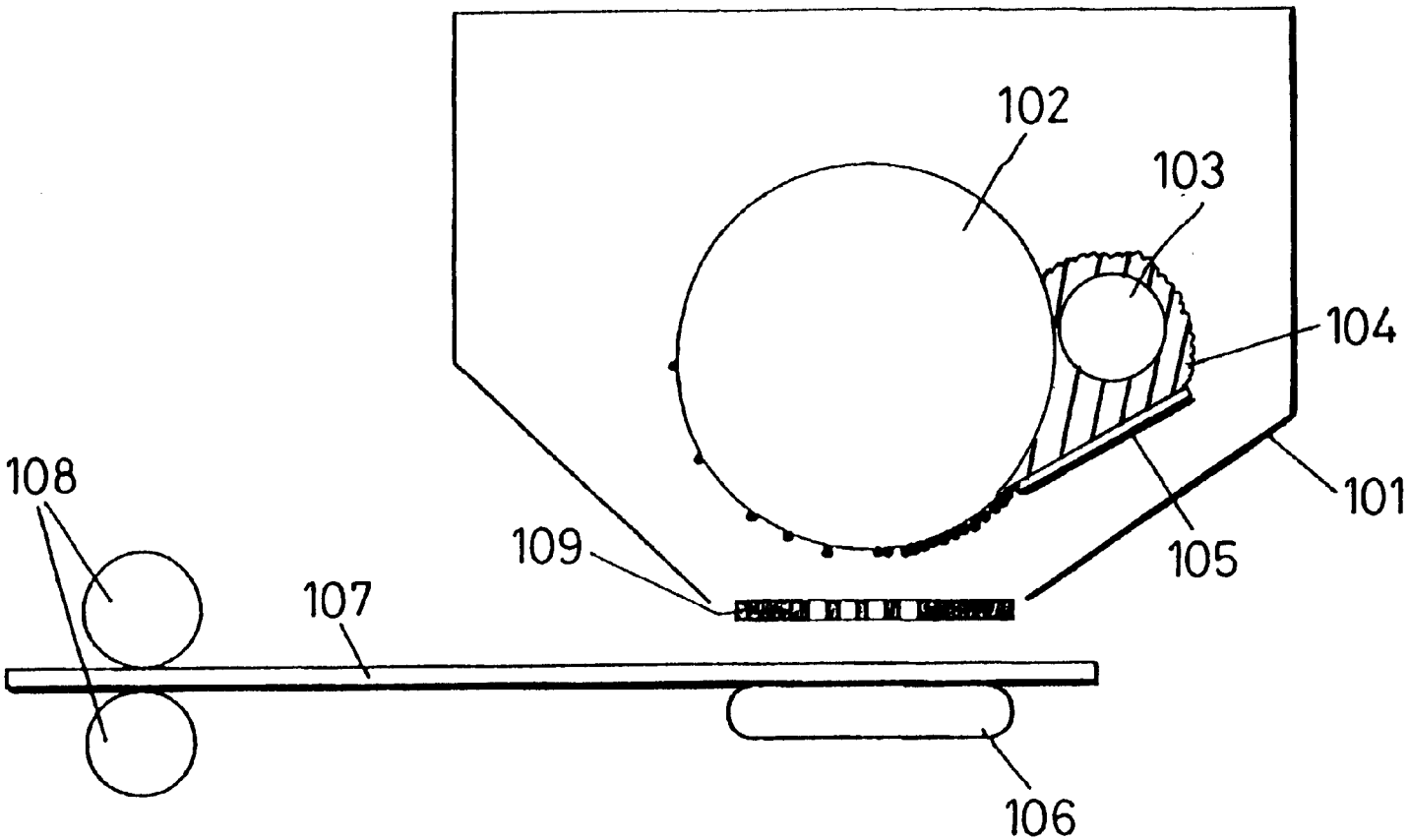
FIG. 7 PRIOR ART
FIG. 7 is a structural view of an image forming apparatus of a conventional embodiment.
Figure 8:
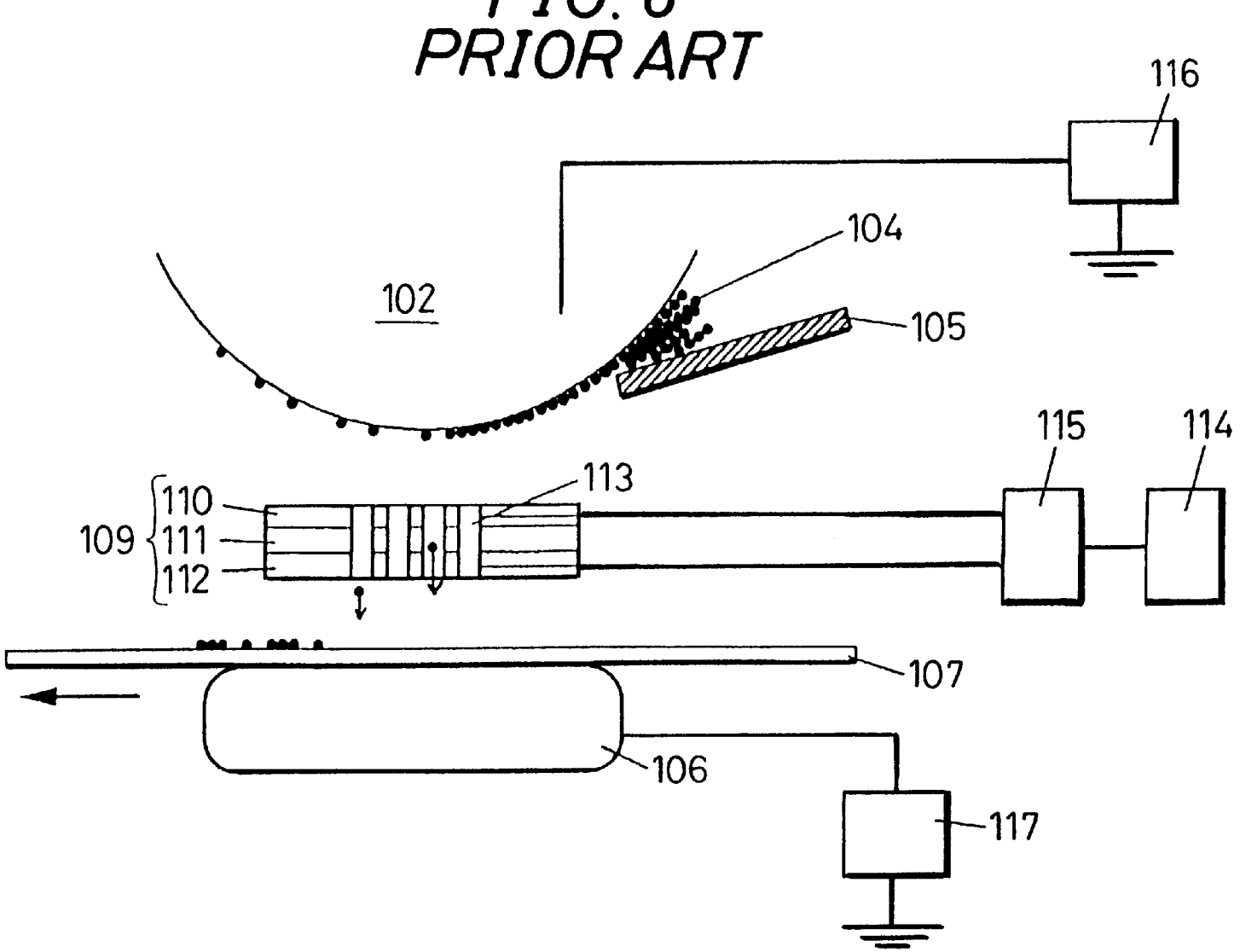
FIG. 8 PRIOR ART
FIG. 8 is an enlarged view of a particle flying part in the conventional embodiment.
Figure 9:
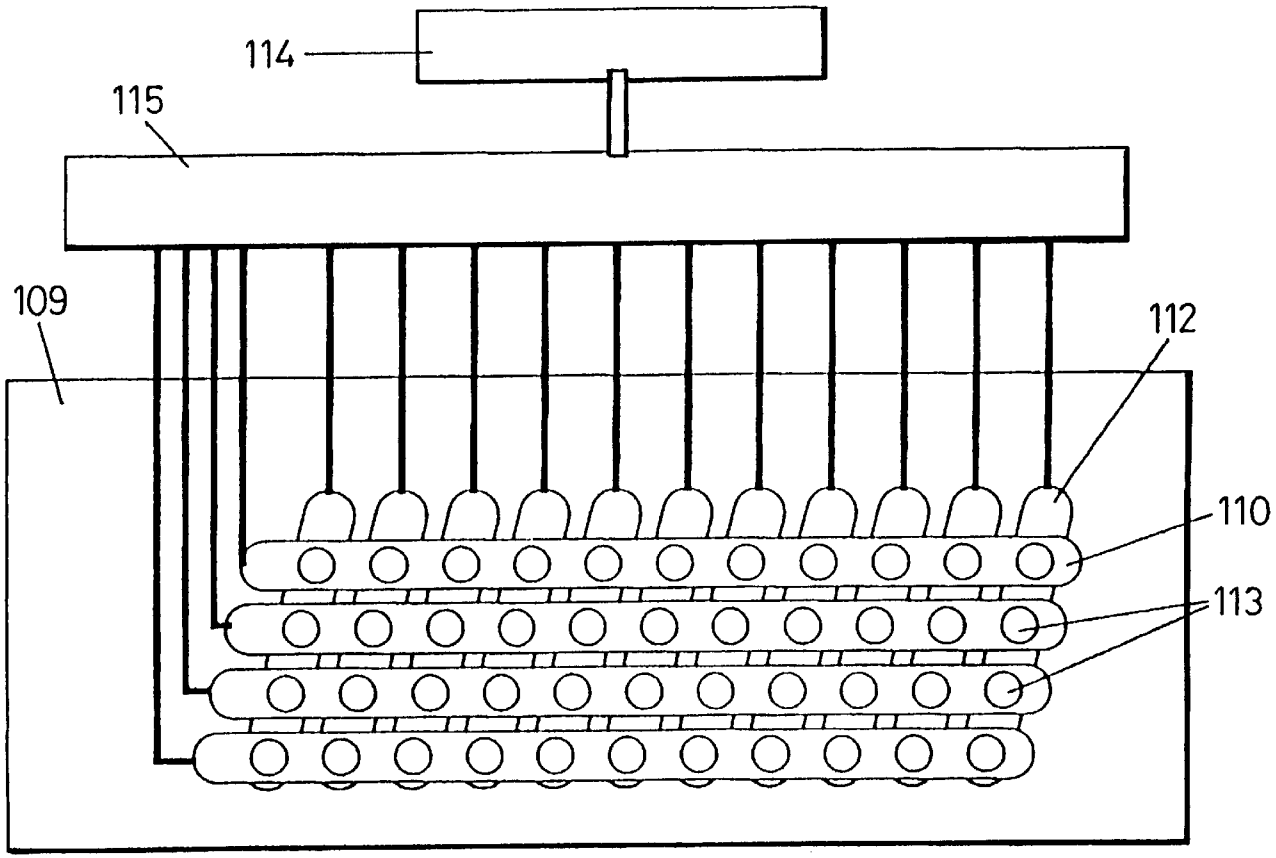
FIG. 9 PRIOR ART
FIG. 9 is an enlarged structural view of a control electrode part in the conventional and present embodiments.

FIG. 5 is a block diagram of an image forming apparatus of the fourth embodiment. FIG. 6 is an enlarged perspective view of a developing particle supplying member of the fourth embodiment of the invention.

In FIG. 5, a lower half periphery of a liquid developing particle supplying member 31 which is electrically conductive is immersed into ink 24 in an ink tank 21. A counter electrode 6 is disposed in a position facing to the liquid developing particle feeder 31 via a control electrode 9.

In the control electrode 9, a plurality of electrodes 10 (X-direction electrodes) arranged in parallel with the longitudinal direction of the liquid developing particle supplying member 31, an insulator 11 in a form of thin film having a thickness of tens of $\mu$m, and a plurality of electrodes 12 (Y-direction electrodes) extending in the direction intersecting with the X-direction electrodes 10 are laminated, and ink particle passing holes 13 are formed in positions where the X-direction electrodes 10 and the Y-direction electrodes 12 intersect with each other.

FIG. 6 shows the structure of the liquid developing particle supplying member 31.

The liquid developing particle supplying member 31 is a member in a form of sheet or board having a thickness of 0.1 mm to 2 mm, with a lot of minute through holes 32 disposed thereon. The number of and relationship among holes are set to correspond to those of the control electrode 9. The size of the holes is predetermined so that an ink particle is thereon formed to have a proper diameter when flying.

As to the image forming apparatus structured in the above manner, the operation thereof is illustrated below. Since the lower surface of the liquid developing particle supplying member 31 is immersed into the ink 24 in the ink tank 21, the ink 24 is sucked up the through holes 32 due to the capillarity. In the meantime, a negative voltage is applied to the liquid developing particle supplying member 31 by an external power supply 23, a charge-injection into the ink 24 is occurred, with the result that the ink 24 is uniformly negatively charged without variations in the amount of electrical charge.

The control electrode 9 is connected to a control circuit 14 which generates a signal in correspondence to an image information and a driving circuit 15 to which a voltage is applied based on the signal. To the X-direction electrode 10 and the Y-direction electrode 12 that are selected in the control circuit 14, is applied −100 V, respectively, when dot printing is carried out, and −300 V is applied when printing is not carried out.

To the ink feeder 31 is applied −200 V, and +400 V is applied to the counter electrode 6. Since to the ink 24 sucked up to the exits of the through holes 32 is a applied −100 V, respectively, by the X-direction electrode and the Y-direction electrode when dot printing is carried out, the ink 24 has higher voltage than the flying start voltage necessary, and receives the force of an electric field to fly in the direction of the ink particle passing holes 13. The ink 24 that is pulled out from the through holes 32 is formed into particles due to the surface tension and thereby fly. The ink 24 that files to the ink particle passing holes 13 receives the force of an electric field in the direction of a recording medium 7 from the counter electrode 6 to which +400 V is applied, thereby transferring on the recording medium 7.

Since the size of the through holes 32 is predetermined so that the ink particle is thereon formed to have a proper diameter, it is easy to obtain ink particles having a uniform diameter and being uniformly charged, without causing the ink particles to split in the course of flying.

When dot printing is not carried out, since −300 V is applied to either the X-direction electrode 10 or the Y-direction electrode 12, or both of them, there is no fear that the negatively charged ink 24 flies toward the ink particle passing holes 13.

In order to show dots as a liner image, the ink particle passing holes 13 are arranged to form four lines of groups of the ink particle passing holes 13 parallel with the longitudinal direction of the liquid developing particle supplying member 31 in a condition where adjacent dots are partially superposed on each other, so that the timing to control is changed for every group of the ink particle passing holes 13 formed to be parallel with the liquid developing particle feeder 31 to thereby form an image.

Lastly, an ink image formed on the recording medium 7 is obtained as a final image after being absorbed and dried on the recording medium.

Although, in the above embodiment, the number of and relationship among the holes are set to correspond to those of the control electrode 9, it is not necessary to set so, and the number and relationship may be arbitrarily selected if proper dots are formed on a recording medium.

In the above embodiments 1 to 4, the potential supplied to the respective electrodes (the liquid developing particle feeder 22 or 31, counter electrode 6, X-direction electrode 10 and Y-direction electrode) can be appropriately changed depending upon the distance between the respective electrodes and the feature of the developing particles, not limited to the above value.

Furthermore, although, in the above embodiments 1 to 4, ink which is liquid at ordinary temperature is used, it is not precluded from using ink which is solid at ordinary temperature by heating to be liquid, without persisting in the above embodiments. In the invention, it is enough that ink is liquid when developing material is charged and made into minute particles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a supplying means for supplying charged developing particles and including a supplying member;

a counter electrode disposed opposite to the supplying member;

a control electrode disposed between the supplying member and the counter electrode and having a plurality of passing holes serving as passages for the developing particles;

wherein while different potentials are applied to the supplying member and the counter electrode, respectively, to generate a predetermined potential difference therebetween, a potential which is to be applied to the control electrode is changed, in order to change an electric field existing between the supplying member and the counter electrode, to thereby control flying of the developing particles passing through the passing holes in a direction from the supplying member to the counter electrode, thereby forming an images;

wherein the developing particles are formed of a liquid or a liquescent material; and wherein the supplying member is configured to charge the developing particles with electricity and to form the developing particles thereon so as to have a desired diameter not more than a predetermined diameter.

2. The image forming apparatus of claim 1, wherein a surface of the supplying member is configured so as to be in a mesh form, where a thickness and size of grain of the formed mesh are established so the developing particles thereon have the desired diameter.

3. The image forming apparatus of claim 2, wherein the supplying member includes a mesh in the grains of which are held the developing particles, the mesh grains being of a size such that the developing particles are formed thereon with the desired diameter.

4. The image forming apparatus of claim 1, wherein a surface of the supplying member is configured with a multiplicity of dimples therein, where a size and depth of the dimples is predetermined so the developing particles formed thereon have the desired diameter.

5. The image forming apparatus of claim 1, wherein a surface of the supplying member is arranged so as to be divided into regions of different wettabilities with respect to the liquid developing particles, where sizes of the regions are established so that the developing particles formed on the surface have the desired diameter.

6. The image forming apparatus of claim 1, wherein the supplying member includes:

a feeder member having a multiplicity of through apertures formed therein; and wherein the feeder member is disposed so one end of the through apertures face towards the control electrode and so the other end of the through apertures is disposed within a source of developing particles.

7. The image forming apparatus of claim 6, wherein the through apertures are sized so that the developing particles exiting from said one end of each through aperture have the desired diameter.

8. The image forming apparatus of claim 6, wherein the through apertures are arranged in the feeder member so as to generally correspond in number and relationship to the passing holes of the control electrode.

9. An image forming method comprising the steps of:

providing a supplying member that supplies charged developer particles formed of a liquid or liquescent material and a control electrode having a plurality of passing holes which serve as passages for the charged developing particles, the charged developing particle having a desired diameter not more than a predetermined diameter;

applying different potentials to the supplying member and a counter electrode disposed opposite to the supplying member, respectively, to generate a predetermined potential difference therebetween; and at the same time, changing a potential to be applied to the control electrode that is disposed between the supplying member and the counter electrode, so as to change an electric field existing between the supplying member and the counter electrode, to thereby control flying of the developing particles passing through the passing holes in a direction from the supplying member to the counter electrode.

* * * * *